US007427911B2

(12) United States Patent
Catchpole

(10) Patent No.: US 7,427,911 B2
(45) Date of Patent: Sep. 23, 2008

(54) ELECTRICAL DEVICE HAVING A HEAT GENERATING RESISTIVE ELEMENT

(75) Inventor: Jonathan Catchpole, Abingdon (GB)

(73) Assignee: Tyco Electronics UK Ltd., Wiltshire (GB)

( * ) Notice: Subject to any disclaimer, the term of this patent is extended or adjusted under 35 U.S.C. 154(b) by 250 days.

(21) Appl. No.: 11/173,045

(22) Filed: Jul. 1, 2005

(65) Prior Publication Data

US 2006/0108353 A1 May 25, 2006

(30) Foreign Application Priority Data

Jul. 5, 2004 (GB) ..... 0415045

(51) Int. Cl.
*H01C 7/10* (2006.01)

(52) U.S. Cl. ..... 338/22 R; 338/51; 338/307; 361/704; 361/714

(58) Field of Classification Search ..... 338/22 R, 338/51, 55, 226, 260, 275, 307, 309, 320; 361/704, 707–708, 713–714, 720, 722
See application file for complete search history.

(56) References Cited

U.S. PATENT DOCUMENTS 3,654,580 A 4/1972 Laisi
3,813,631 A 5/1974 Matsuda et al.
3,955,169 A 5/1976 Kerfoot et al.
4,613,844 A * 9/1986 Kent et al. ..... 338/314
4,677,413 A * 6/1987 Zandman et al. ..... 338/7
4,716,396 A * 12/1987 Kneifel ..... 338/226
4,899,126 A 2/1990 Yamada
5,274,352 A 12/1993 Nishikawa et al.
5,355,281 A 10/1994 Adelmann et al.
5,481,241 A * 1/1996 Caddock, Jr. ..... 338/51
5,510,594 A 4/1996 Mori et al.
5,990,780 A * 11/1999 Caddock, Jr. ..... 338/309

FOREIGN PATENT DOCUMENTS

DE 43 00 084 A1 7/1994
EP 0 713 227 A1 5/1996
EP 0770 662 A2 5/1997

* cited by examiner

*Primary Examiner*—K. Richard Lee
(74) *Attorney, Agent, or Firm*—Barley Snyder LLC

(57) ABSTRACT

The invention provides an electrical device having improved insulation and reduced partial discharge. The electrical device comprises an electrically conductive resistive element provided on a heat transfer medium for transferring heat from the element. The heat transfer medium includes a layer or body of electrically conductive material and a layer of thermally conductive dielectric material disposed between the element and the electrically conductive material. A continuous film of electrically insulating material, for example a silica over-glaze or polymer encapsulant, is applied around the perimeter of the resistive element to surround the element with the film overlying the edge or edges of the element and the ceramic material adjacent thereto.

18 Claims, 5 Drawing Sheets

ELECTRICAL DEVICE HAVING A HEAT GENERATING RESISTIVE ELEMENT

FIELD OF THE INVENTION

This invention relates to electrical devices such as power resistors and the like and in particular concerns improvements relating to the electrical insulation of such devices.

BACKGROUND

Electrical devices such as power resistors and the like generate significant heat during operation and it is usual to provide such devices with a heat transfer medium for transferring heat from the device to a suitable heat sink such a metal plate or other body of heat conducting material.

A power resistor is described in U.S. Pat. No. 5,355,281 in which a heat generating electrically conductive element is secured to one side of a bonded ceramic-copper laminate plate. The heat-generating element is enclosed within a resistor housing by attachment of the heat conducting plate to an open end of the housing. The laminated plate comprises an intermediate layer of nickel-plated copper sandwiched between first and second alumina (aluminum oxide) ceramic layers. The heat-generating element is secured to the alumina substrate on one side of the plate while the ceramic substrate on the other side of the plate is nickel-plated and is located on the exterior of the assembled device. Internally, the element is electrically connected to a terminal provided on the exterior of the housing. Typically, in devices of this type, the interior of the housing is filled with a so-called "potting compound" of silicon resin insulating material which is mixed under vacuum conditions to eliminate voids in the insulation so that partial discharge of the high voltage resistor element is minimized during operation.

The service life of high voltage electrical devices is usually limited by breakdown of the insulation, as measured by partial discharge. Partial discharge increases over time as insulation deteriorates due to the growth of voids in the body of the insulation material due to spark erosion. Spark erosion of the insulation occurs due to variations in the electrical field strength at voids in the body of the insulation material and at the edges of the insulation where divergence of the electrical field is greatest. Although partial discharge can be measured relatively easy, it is extremely difficult to predict or observe where it occurs.

It is therefore desirable to improve the quality of the insulation and hence partial discharge characteristics and service life of high voltage electrical devices such as power resistors of the aforementioned type.

SUMMARY

An electrical device is provided comprising an electrically conductive resistive element on a ceramic substrate for transferring heat from the element. A continuous film of electrically insulating material is applied around the perimeter of the resistive element so that the insulating film surrounds the element with the film overlying the edge or edges of the element and the dielectric material adjacent thereto.

BRIEF DESCRIPTION OF THE DRAWINGS

Various embodiments of the invention will now be more particularly described, by way of example only, with reference to the accompanying drawings, in which.

DETAILED DESCRIPTION OF THE EMBODIMENTS

Figure 1:
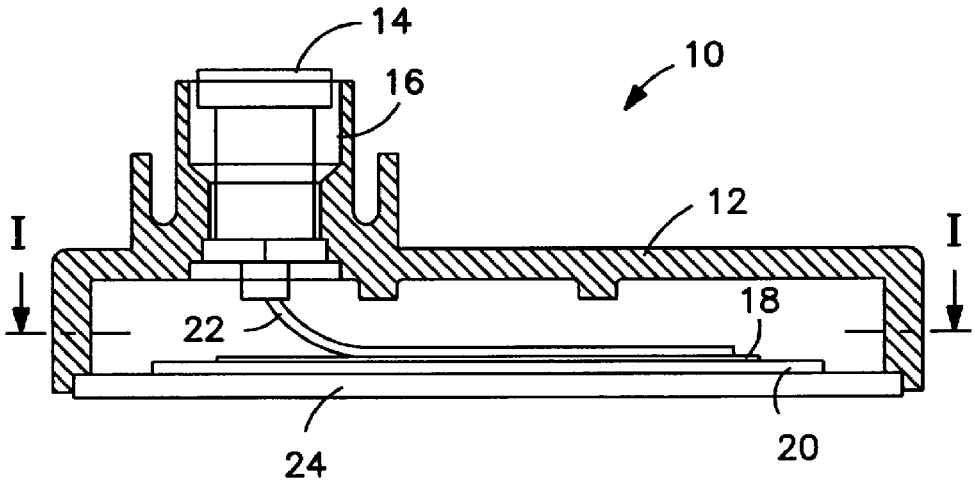
FIG. 1 is a cross-sectional view of a power resistor according to an embodiment of the present invention.

Referring to FIG. 1, an electrical device 10 comprises a power resistor, that is, a resistor having a power rating of 1 watt or more. It should be understood however, that the electrical device may alternatively be a power resistor, semiconductor or diode for example. The device includes an injection-molded housing 12 having a pair of electrical terminals 14 (only one of which is shown in the drawing of FIG. 1) which extend through respective bore openings 16 in the housing 12. Embodiments are also envisaged where four terminals 14 are provided. The terminals 14 are electrically connected to a resistor comprising a resistive element 18 provided on a thermally conductive dielectric ceramic substrate 20. The thermally conductive dielectric substrate 20 may comprise a ceramic material or mica. The dielectric material may be provided on an electrically conductive substrate, for example a plasma sprayed coating on an aluminium substrate or as a porcellainised steel. In this embodiment, the ceramic substrate 20 comprises an aluminium oxide substrate. The terminal 14 is connected to the resistive element 18 by a connecting lead 22 soldered to the resistive element 18 as explained in more detail below. The ceramic substrate 20 is bonded, preferably soldered, to a nickel-plated copper base plate 24 which constitutes a heat sink of the electrical device. The housing is bonded to the base plate 24, preferably by a silicon-based adhesive.

The housing 12 sits on the base plate 24 so that the interior of the housing 12 is closed by the base plate 24. The interior of the housing 12 is "potted" with a silicon resin insulating material in a manner well known to those skilled in the art. Collectively, the ceramic substrate 20 and base plate 24 define a heat transfer medium for transferring heat generated by the resistive element 18 in use.

Figure 2:
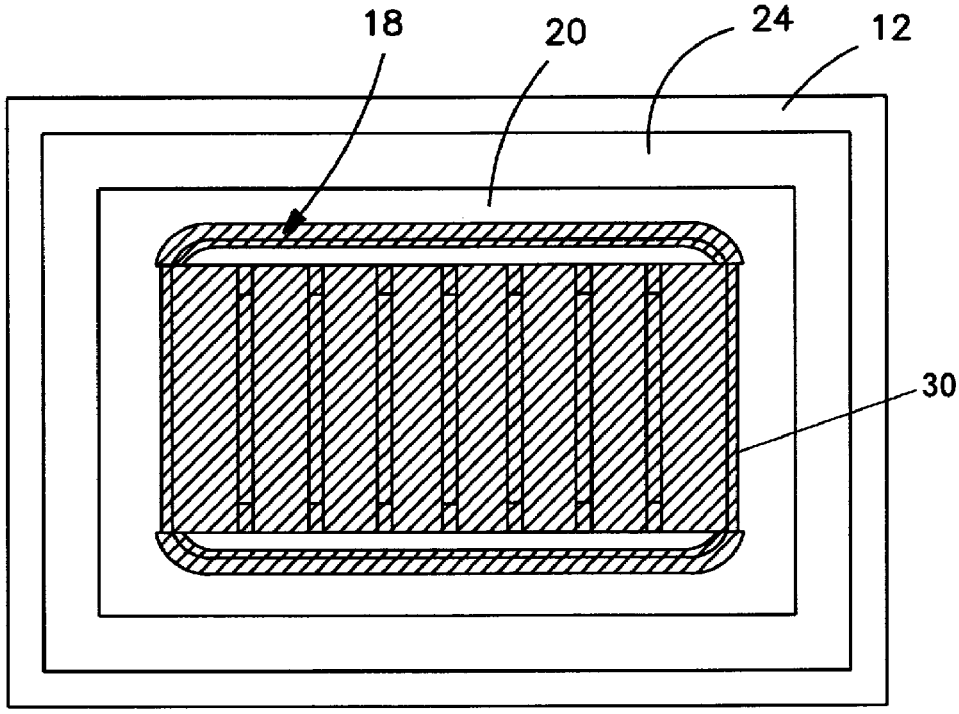
FIG. 2 is a plan cross-sectional view taken along line I-I of FIG. 1.

The resistive element 18 is shown in greater detail in the plan cross-sectional view of FIG. 2. The detailed construction of the resistive element 18 is best explained with reference to the drawings of FIGS. 3 to 5 which show sequentially the manufacturing steps of the resistive element 18.

Figure 3:
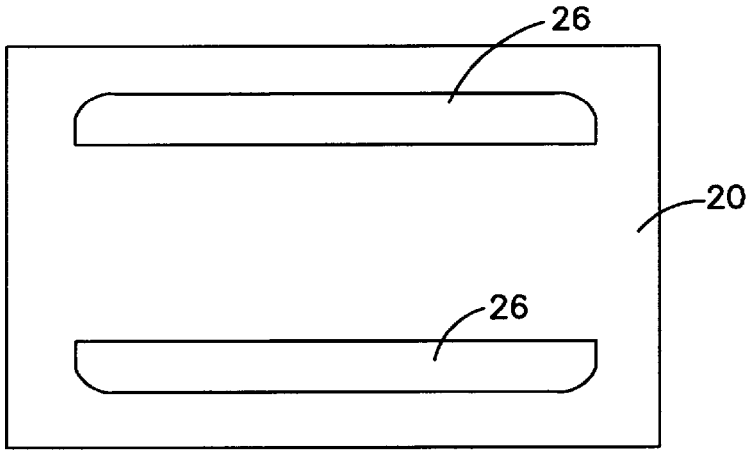
FIG. 3 is a plan view of a ceramic substrate having a conductive film printed thereon.
Figure 4:
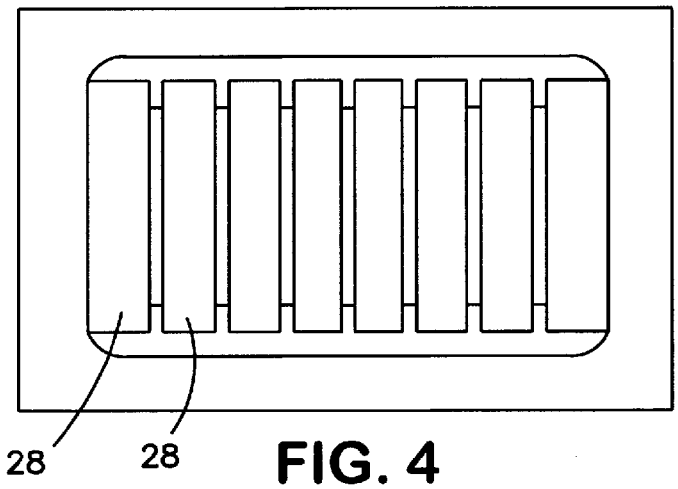
FIG. 4 is a plan view of the ceramic substrate of FIG. 3 having a plurality of thin film resistive strips printed on the substrate.

In FIG. 3 parallel metal strips 26 of silver/palladium or silver/platinum metal alloy are printed on the substrate 20 to provide a pair of parallel conductive metal films for electrical contact to the terminals 14. The metal strips 26 are fired onto the surface of the substrate 20 forming metallic film contacts and then a plurality of parallel electrically resistive strips 28 are applied to the substrate spanning the gap between the metal strips 26 and partially overlapping the edges of the metal strips 26 at the respective longitudinal ends of the resistive strips 28 such that each resistive strip 28 provides an electrical connection between the metal strips 26. The resistive strips 28 are applied to the substrate 20 by screen printing a resistive ink on the surface of the substrate 20 and metal film contacts 26. The resistive ink is printed as a thick film, typically 15 to 20 microns. Once the resistive film has been printed, it is fired.

In embodiments in which the resistive element 18 comprises a resistive film applied to the surface of the substrate 20, the resistive film 18 may comprise a resistive ink printed on the surface of the substrate 20. In such embodiments, it is desirable to first print the metallic film forming the contact or contacts and then the resistive film 18 partially overlapping the metallic film so that the resistive film 18 forms an electrical connection with the metallic film.

Figure 5:
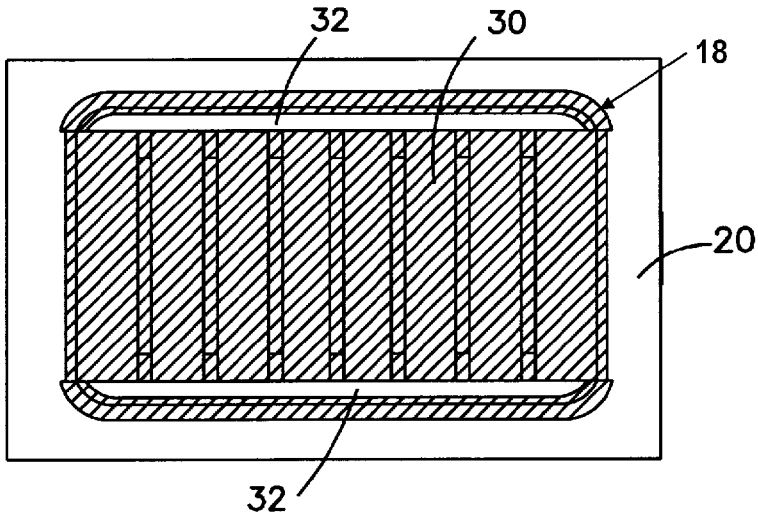
FIG. 5 is a plan view of the substrate of FIG. 4 having a film of insulating material thereon.

An electrically insulating film 30, for example a thick film silica glaze or polymer encapsulant, is applied to the entire region of the resistive element 18 on the substrate 20, as shown by the hatched area in the drawing of FIG. 5. The insulating film 30 comprises a thick film silica over-glaze. The over-glaze may comprise, for example, a low temperature glass encapsulant composition or any similar material suitable for forming an insulating and protective (passivation) layer over thick film circuits, particularly over thick film resistors. The insulating film may comprise a thick film polymer encapsulant composition suitable for encapsulation applications on resistor networks and the like. In other embodiments, thin film dielectric materials, such as quartz or alumina, may be used instead. The thickness of the insulating film 30 is typically in the range of 3 to 25 microns, and preferably 5 to 20 microns. In embodiments where the insulating film comprises a thick film silica over-glaze or thick film polymer encapsulant the film thickness is preferably 15 to 20 microns. In embodiments where a thin film quartz or alumina dielectric is used the insulating film typically has a thickness of 5 to 10 microns due to the higher dielectric strength of these materials. The insulating film 30 is applied around the entire perimeter of the resistive element 18 so that it surrounds the resistive element 18 with the film 30 overlying the edges of the resistive element 18 and the surface of the ceramic substrate 20 adjacent thereto. As can be seen in FIG. 5, the insulating film 30 is applied as a rectangular block covering the resistive strips 28 including the region between the resistive strips 28 as well as the ceramic substrate 20 immediately adjacent to the end resistive strips 28. The film is also applied around the edges of the metal strips 26 forming the film contacts on opposite sides of the resistive element 18. Film-free contact regions 32 are provided on the strips 26 for electrical connection of the resistive element 18. The film-free contact regions 32 are printed with a solder paste for reflow soldering to the connecting leads 22. The insulating film 30 overlaps the strips 26 by about 2 mm or so around its periphery and by the same amount around the respective edges of the end resistive strips 28 adjacent to the respective edges of the substrate 20. In an alternative embodiment, to the one illustrated, the insulating film 30 may be applied over the whole surface of the substrate 20, except for contact regions 32, such that the film is applied up to the edges of the substrate 20 and, if desired, on the surface of the respective side edges of the substrate 20.

Figure 6:
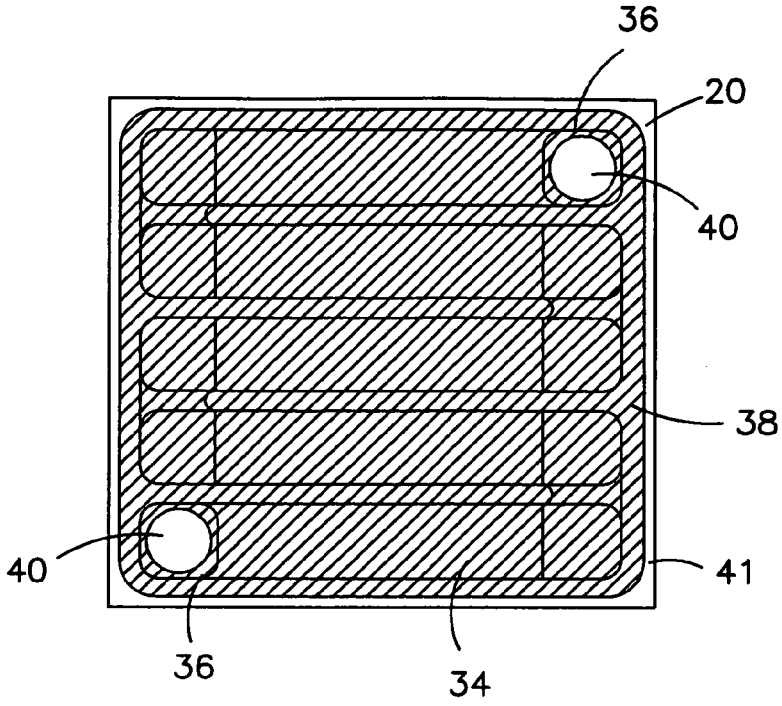
FIG. 6 is a view similar to that of FIG. 5 of a ceramic substrate having a different pattern of resistive film, electrical contacts and insulated film on the substrate.

Referring now to FIG. 6, in this embodiment the resistive element 18 has a different configuration to that shown in FIGS. 2 to 5. In this embodiment the resistive element 18 comprises a resistive film 34 in the form of a serpentine provided on the surface of the substrate 20. The resistive film 34 is preferably applied to the surface of the substrate 20 by vacuum deposition. The resistive film 34 terminates at metal film contacts 36 positioned at both ends of the resistive film 34. In this arrangement, the insulating film 38 is applied over the entire area of the resistive film 34 as indicated by the hatched region. The insulating film 38 defines a border 41 around the edges of the resistive element 18 between the resistive element 18 and the respective edges of the ceramic substrate 20. Insulating film-free regions 40 are provided on the resistive film 34 to allow electrical connection thereto as described.

Figure 7:
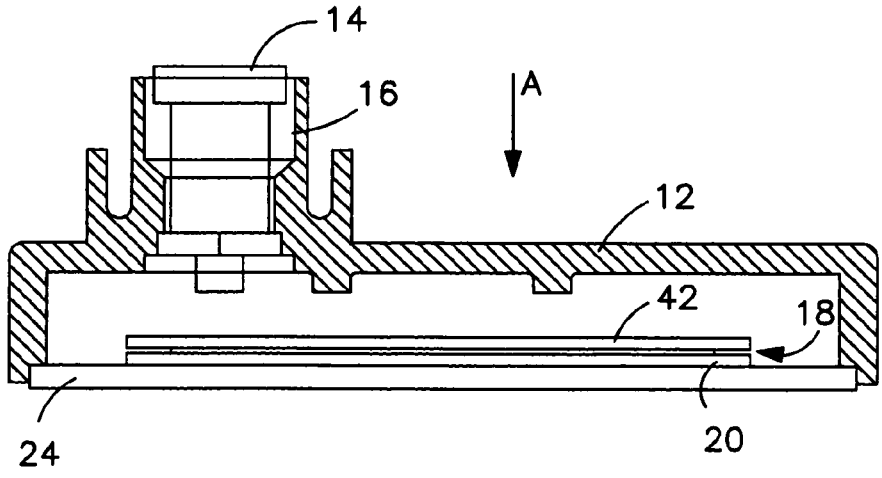
FIG. 7 is a cross-sectional view of a power resistor according to a second embodiment of the invention.

The electrical device of FIG. 7 is similar to that of FIG. 1, except that the heat generating resistive element 18 is disposed between ceramic substrate 20, bonded to the base plate 24 as before, and a second ceramic substrate tile 42 in the interior of the housing 12.

Figure 8:
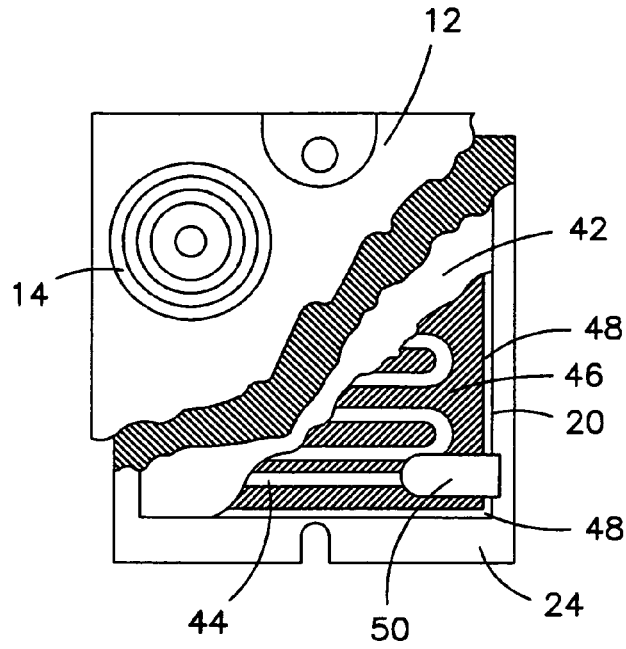
FIG. 8 is a partial cut away view of the power resistor of FIG. 7, as viewed in direction A in the drawing of FIG. 7.

The resistive element 18 of the embodiment of FIG. 7 has a different construction to the resistive element 18 of FIG. 1 and is best described with reference to FIG. 8. FIG. 8 is a partial cut away plan view of the device shown in FIG. 7, as indicated in the direction of arrow A in FIG. 7. In this embodiment the resistive element 18 comprises an etched metal foil 44 in the form of a serpentine sandwiched between ceramic substrate tiles 20 and 42.

The surface of the substrate 20 facing the second ceramic tile 42 is coated over the majority of its area with a high resistance thick film 46, typically a screen printed resistive ink which is fired to provide a film having a thickness of 15 to 20 microns. The high resistance thick film 46 is provided on at least the area of the substrate 20 in contact with the metal foil 44, and in the embodiment of FIG. 8 is applied as a rectangular block on the rectangular substrate 20 such that a resistance film-free border region 48 remains around the edge of the ceramic substrate 20 to reduce potential discharge between the resistive element 18 and the ground plane. The width of the border region 48 may be, for example, in the range 1 to 3 mm. The high resistance thick film 46 electrically connects the surface of the substrate 20 to the metal foil 44 at the same electrical potential.

As previously mentioned in relation to the embodiment of FIG. 1 the surface of the substrate 20 in contact with the base plate 24 is provided with a conductive film coating so that this side of the substrate 20 can be electrically connected to the base plate 24, preferably by reflow soldering. Contacts 50 (only one of which is shown in the drawing of FIG. 8) are provided at the respective ends of the metal foil 44. The contacts 50 are integral with the metal foil 44 and provide increased surface area for connecting respective terminals (not shown in FIG. 7) by well know resistance welding methods. The metal foil 44 is joined to the substrates 20 and 42 by a thermally conductive adhesive applied to a small, preferably central, area of the metal foil 44.

Figure 9:
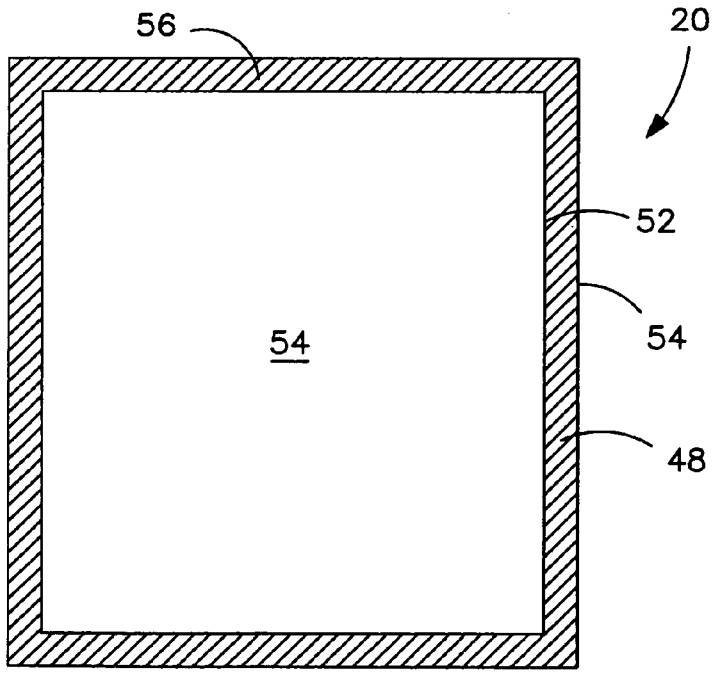
FIG. 9 is a plan view of a ceramic substrate having a high resistance film and insulating film applied thereto.

The edges of the high resistance thick film 46 are coated with an insulating film, for example a silica over-glaze or polymer encapsulant, in a similar way that the edges of the resistive element 18 in the embodiment of FIG. 1 are coated. The insulating film extends around the whole area of the surface of the substrate coated with the high resistance thick film 46. The insulating film is applied as a strip of material having a width of say 2 mm overlapping the edges of the high resistance thick film 46 and the adjacent ceramic material around the border region 48. This can best shown in the drawing of FIG. 9, which schematically shows the location of the high resistance thick film 46. In FIG. 9 the outline of the ceramic substrate 20 is shown in plan view with the area of the high resistance thick film 46 shown in the central region of the substrate 20. The edges of the high resistance thick film 46 are indicated at 52 and the edges of the ceramic substrate at 54. The area over which the high resistance thick film 46 is applied is indicated by the diagonal hatched lines 56 which surround the border region 48 of the ceramic substrate 20. As can be seen in FIG. 9, about one-third of the width of the insulating film overlaps the high resistance thick film 46 along the edges 52, whilst the remaining two-thirds overlaps the surface of the ceramic substrate 20 covering the ceramic material immediately adjacent to the edges 52 but not the full width of the border region between the edges 52 and edges of the substrate 20.

Figure 10:
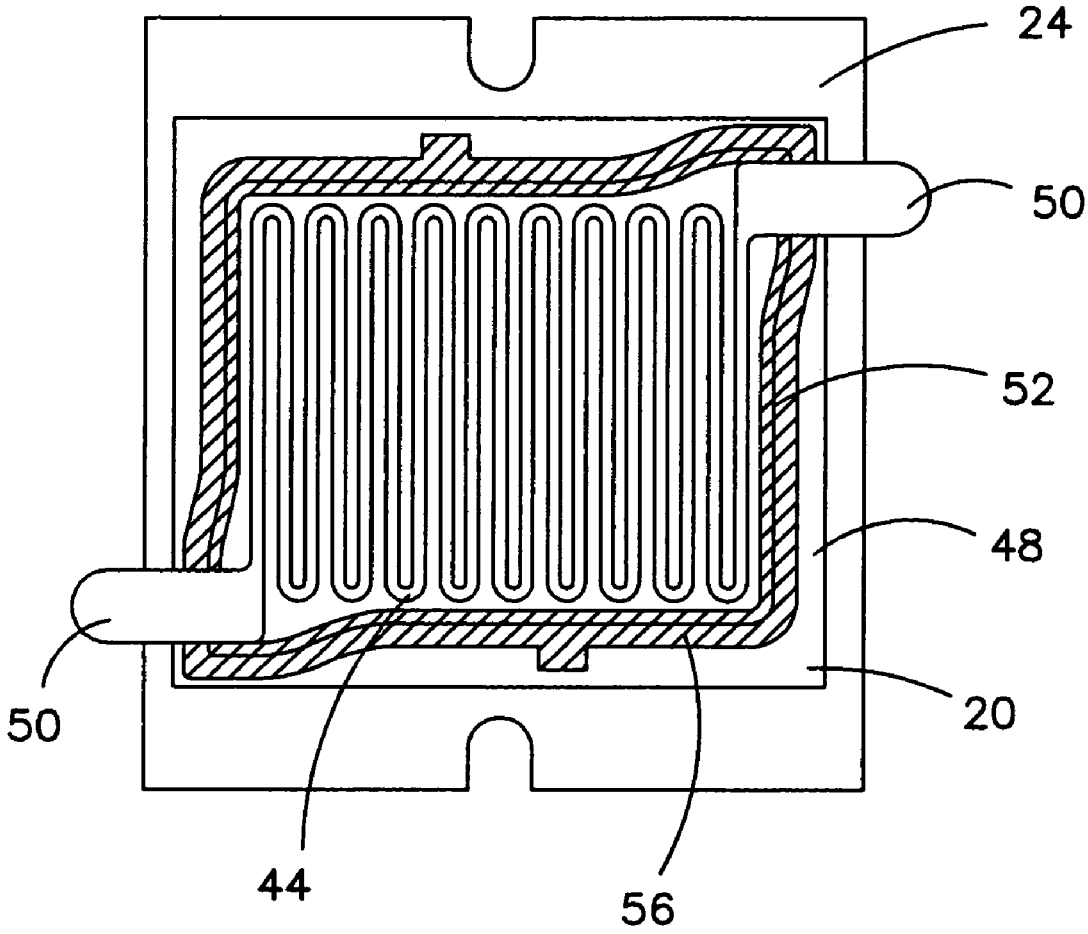
FIG. 10 is a plan view similar to FIG. 8 of a different embodiment of power resistor.

FIG. 10 is a plan view similar to FIG. 8 of a slightly different embodiment in which the border region 56 of insulating film is applied closer to the edges of the substrate 20 at the corners of the substrate where the contacts 50 are located. The border region 56 in FIG. 10 has a slightly skewed shape compared with the rectangular frame of the border region 56 in the embodiment of FIG. 9.

Although aspects of the invention have been described with reference to the embodiments shown in the accompanying drawings, it is to be understood that the invention is not limited to those precise embodiments and that various changes and modifications may be effected without further inventive skill and effort. For example, the invention also contemplates embodiments in which the resistive element is provided on a cylindrical (tubular or solid) or arcuate shaped dielectric substrate. In addition the resistive element may be provided on more than one surface of the substrate, for example the element may be provided on two adjoining surfaces of a dielectric substrate. The electrical device may comprise a plurality of resistive elements each provided on a separate layer of dielectric material in a laminated structure.

The invention contemplates electrical devices at various stages of assembly with the dielectric substrate joined to a layer or body of thermally, and possibly, electrically conductive material such as a metallic heat sink and also devices having a resistive element provided on a dielectric substrate only.

Advantageously, the continuous film of insulating material surrounding the resistive element can significantly reduce partial discharge of the device. By overlying the edge or edges of the resistive element, and the adjacent dielectric, preferably ceramic material, the film can minimise high voltage divergent fields, particularly at surface discontinuities such as at the corners and edges of the resistive element.

What is claimed is:

1. An electrical device comprising:

an electrically conductive resistive element provided on a thermally conductive dielectric material for transferring heat from the element; and a continuous film of electrically insulating material applied around the perimeter of the resistive element so that the insulating film surrounds the element with the film overlying the edge or edges of the element and the dielectric material adjacent thereto, the continuous film of electrically insulating material being inwardly offset from an outer edge of a substrate to which the dielectric material is mounted.

2. The device as claimed in claim 1 wherein the insulating film comprises a silica film over glaze, a polymer encapsulant, or a quartz or alumina dielectric.

3. The device as claimed in claim 2 wherein the thickness of the insulating film is in the range of 3 to 25 microns.

4. The device as claimed in claim 1 wherein the resistive element is applied to the surface of the dielectric material and comprises at least one electrical contact on the surface and wherein the film overlies the edge or edges of the contact and the dielectric material immediately adjacent thereto.

5. The device as claimed in claim 4 wherein the insulating film is applied over substantially the whole area of the resistive element with the contact having at least one insulating film free region surrounded by the film for electrical connection thereto.

6. The device as claimed in claim 5 wherein the contact comprises a film of conductive material applied to the surface of the dielectric material.

7. The device as claimed in claim 4 wherein the resistive element comprises a resistive film applied to the surface of the dielectric material and the contact.

8. The device as claimed in claim 6 wherein the resistive film comprises a resistive ink printed on the surface of the dielectric material.

9. The device as claimed in claim 1 wherein the insulating film is applied around the perimeter of the resistive film overlying the edge or edges of a resistive film and the dielectric material adjacent thereto.

10. The device as claimed in claim 1 wherein the dielectric material comprises alumina.

11. The device as claimed in claim 1 wherein the dielectric material comprises a substantially planar ceramic tile.

12. The device as claimed in claim 11 wherein a conductive film is applied to a face of the tile adjacent to a layer or body of electrically conductive material.

13. The device as in claim 1 wherein the resistive element is enclosed within a casing containing an insulating material.

14. The electrical device as claimed in claim 1 wherein the device comprises a power resistor.

15. The electrical device as claimed in claim 1 wherein the thermally conductive dielectric material is disposed between the resistive element and a second layer or body of thermally conductive material.

16. The electrical device as claimed in claim 15 wherein the second layer or body of thermally conductive material comprises an electrically conductive material.

17. The electrical device as claimed in claim 1 wherein the thermally conductive dielectric material comprises a ceramic material or mica.

18. An electrical device comprising:

an electrically conductive heat generating resistive element;

a heat transfer medium on which the element is placed for transferring heat from the element, the heat transfer medium having a layer or body of electrically conductive material and a layer of thermally conductive dielectric material disposed between the element and the electrically conductive material, the element being in contact with a resistive film provided on the surface of the dielectric material facing the element; and a continuous film of electrically insulating material applied around the perimeter of the resistive film overlying the edge or edges of the resistive film and the dielectric material adjacent thereto, the continuous film of electrically insulating material being inwardly offset from an outer edge of a substrate to which the dielectric material is mounted.

* * * * *